US010544549B2

(12) United States Patent
Thomas et al.

(10) Patent No.: US 10,544,549 B2
(45) Date of Patent: Jan. 28, 2020

(54) ATHLETIC FIELD SAFETY BORDER

(71) Applicant: Pro Grass LLC, Sharpsburg, PA (US)

(72) Inventors: Robert W. Thomas, Cranberry Township, PA (US); Thomas Rombach, Sarver, PA (US); Joseph Gaeta, Oakmont, PA (US)

(73) Assignee: Pro Grass LLC, Sharpsburg, PA (US)

( * ) Notice: Subject to any disclaimer, the term of this patent is extended or adjusted under 35 U.S.C. 154(b) by 183 days.

(21) Appl. No.: 15/232,454

(22) Filed: Aug. 9, 2016

(65) Prior Publication Data

US 2017/0044725 A1 Feb. 16, 2017

Related U.S. Application Data

(60) Provisional application No. 62/203,587, filed on Aug. 11, 2015.

(51) Int. Cl.

| | |
|---|---|
| ***E01C 13/08*** | (2006.01) |
| ***E01C 5/00*** | (2006.01) |
| ***E01C 5/18*** | (2006.01) |
| ***E01C 5/22*** | (2006.01) |

(52) U.S. Cl.

CPC ..... *E01C 13/08* (2013.01); *E01C 5/003* (2013.01); *E01C 5/18* (2013.01); *E01C 5/226* (2013.01); *E01C 13/083* (2013.01); *Y10T 428/23929* (2015.04); *Y10T 428/24777* (2015.01)

(58) Field of Classification Search

CPC ..... E01C 13/08; E01C 13/083; E01C 5/003; E01C 5/18; E01C 5/226; Y10T 428/2477; Y10T 428/23929; Y10T 428/24777

See application file for complete search history.

(56) References Cited

U.S. PATENT DOCUMENTS

| | | | | |
|---|---|---|---|---|
| 4,934,093 | A * | 6/1990 | Yanna | A01G 13/0281 404/7 |
| 5,853,265 | A | 12/1998 | Gunter | |
| 6,012,254 | A * | 1/2000 | Gaston | F21V 21/0824 52/102 |
| 6,324,782 | B1 * | 12/2001 | Gaston | A01G 9/28 47/33 |
| 6,616,542 | B1 * | 9/2003 | Reddick | A63B 69/3661 428/17 |
| 6,925,753 | B1 * | 8/2005 | Mallory | A01G 9/28 47/33 |
| 7,051,477 | B2 * | 5/2006 | Burnham | A01G 9/28 47/33 |

(Continued)

FOREIGN PATENT DOCUMENTS

| | | | |
|---|---|---|---|
| AU | 2016100393 | A4 * | 5/2016 |
| EP | 0109065 | A1 | 5/1984 |

*Primary Examiner* — Cheryl Juska

(74) *Attorney, Agent, or Firm* — Harness, Dickey & Pierce, P.L.C.

(57) ABSTRACT

A border member for establishing a border around a synthetic turf field comprises: an elongated body molded from a flexible material; at least one notch formed in an upper surface of the elongated body and extending along a length of the elongated body; and a rigid spine embedded within the elongated body and extending along the length of the elongated body. The border member is positioned adjacent to the synthetic turf field such that a portion of synthetic turf of the synthetic turf field rests on the notch.

7 Claims, 6 Drawing Sheets

(56) References Cited

U.S. PATENT DOCUMENTS

| | | | | | |
|---|---|---|---|---|---|
| D555,440 | S * | 11/2007 | Murray | A01G 9/28 | D8/1 |
| 7,774,993 | B2 * | 8/2010 | Strobl, Jr. | A01G 9/28 | 52/102 |
| 8,407,948 | B1 * | 4/2013 | Nash | E02D 27/00 | 52/102 |
| 9,109,337 | B2 * | 8/2015 | Wink | E01C 11/222 | |
| 9,173,350 | B1 * | 11/2015 | Beutler | A01G 9/28 | |
| 9,578,812 | B2 * | 2/2017 | Moita | A01G 1/08 | |
| 2005/0129906 | A1 * | 6/2005 | Knox | E01C 13/08 | 428/95 |
| 2007/0237940 | A1 * | 10/2007 | Branca | E04B 1/30 | 428/297.4 |
| 2010/0059090 | A1 * | 3/2010 | Ennis | B08B 17/00 | 134/45 |
| 2011/0277395 | A1 * | 11/2011 | Wink | E01C 11/222 | 52/102 |
| 2012/0276342 | A1 * | 11/2012 | Bray | E01C 13/08 | 428/174 |
| 2013/0239473 | A1 * | 9/2013 | Kalamaris | A01G 9/28 | 47/33 |
| 2014/0237927 | A1 * | 8/2014 | Bray | E01C 13/08 | 52/403.1 |
| 2014/0287169 | A1 * | 9/2014 | Guentner | B29C 45/14467 | 428/17 |
| 2015/0098758 | A1 * | 4/2015 | Krauss | E01C 13/08 | 404/47 |
| 2015/0139742 | A1 * | 5/2015 | Fellars | E01C 13/08 | 405/302.7 |
| 2018/0030671 | A1 * | 2/2018 | Fellars | E01C 13/08 | |
| 2018/0371706 | A1 * | 12/2018 | Ziegan | E01C 13/08 | |

* cited by examiner

| TEST POINT - TEST DESCRIPTION<br>A STM STANDARD F355F1936-10 | DROP<br># | GMAX | TMAX<br>MS | SURF<br>°F |
|---|---|---|---|---|
| SAFE - T - BORDER | | | | |
| SAMPLE 1 - SAFE - T - BORDER OVER ASPHALT | 1 | 98.6 | 4.5 | |
| | 2 | 100.2 | 4.5 | |
| | 3 | 98 | 4.6 | |
| | AVG 2 & 3 | 99.1 | 4.6 | 102 |
| SAMPLE 2 - SAFE - T - BORDER INSTALLED AT TUM 4 | 1 | 84.5 | 4.8 | |
| | 2 | 84.9 | 3.9 | |
| | 3 | 85.3 | 4.1 | |
| | AVG 2 & 3 | 85.1 | 4 | 106 |
| SAMPLE 3 - SAFE - T - BORDER INSTALLED AT FRONT STRAIGHT | 1 | 74.1 | 5.9 | |
| | 2 | 75.8 | 5.7 | |
| | 3 | 77.8 | 5.9 | |
| | AVG 2 & 3 | 76.8 | 5.8 | 106 |
| OTHER MATERIALS | | | | |
| 1 - 6 - 1" TREX OVER ASPHALT | 1 | 406.5 | 0.5 | |
| 2 - 4 - 1 1/2" PLYWOOD OVER ASPHALT | 2 | 243.7 | 0.7 | |
| 3 - 1/2" RUBBER TRACK SURFACING OVER ASPHALT - TURN 4 | 3 | 308.9 | 0.6 | |
| 4 - ASPHALT - DROP FROM 1" | 4 | 506.3 | 0.5 | |
| 5 - CONCRETE - DROP FROM 1" | 5 | 651 | 0.4 | 69 |

FIG. 8

ATHLETIC FIELD SAFETY BORDER

CROSS REFERENCE TO RELATED APPLICATIONS

This application claims priority to U.S. Provisional Application Ser. No. 62/203,587, filed Aug. 11, 2015, entitled "Athletic Field Safety Border", the entire disclosure of which is hereby incorporated by reference.

BACKGROUND OF THE INVENTION

Field of the Invention

The present invention is generally directed to borders for synthetic and natural grass turf as well as borders for play areas such as playgrounds and, more specifically, to a system for bordering synthetic grass turf that is safe and provides an aesthetically appealing appearance.

Description of Related Art

Many athletic fields are either being converted from a natural grass covering to an artificial, or synthetic, turf covering or built new using synthetic turf because synthetic turf coverings are typically less expensive and less time-consuming to maintain compared to natural grass coverings. In addition, natural grass coverings can be difficult to grow in some environments, such as desert regions, spaces shaded by buildings, domed fields, and high traffic areas.

Synthetic turf coverings have improved over the years. Such coverings now have a very similar appearance to natural grass coverings. Other improvements to synthetic turf systems include the use of impact attenuating safety padding that provides additional cushioning and elasticity, thus giving synthetic turf nearly the same advantages as natural grass coverings.

Typically, synthetic turf is comprised of a layer of a geotextile backing with grass like fibers sewn into the backing to replicate grass. Some synthetic turfs have thatch zones which are attached to the backing. Others have porous material such as rubber crumb and sand installed into the grass like fiber area to act as topsoil to provide cushioning and safe G-Max levels. Some synthetic turfs are made with a preference being placed upon a more natural appearance and texture. In order to achieve a preferred artificial grass length, shorter filaments and filler may be added to supplement fullness and provide upright support as required for certain uses.

Most synthetic turf installations utilize the synthetic turf material to cover the playing area but the peripheral edges of the playing area, such as around the sidelines of a football field, are not covered with the turf material. Many athletic fields will utilize concrete curbing and other hard materials to act as a border separating the field from a running track and events. In addition, similar hard borders are often used to separate park play areas from walkways or used to transition synthetic turf to natural grass areas. In such instances, it is necessary to provide a system for securing the edges of the synthetic turf material in place. Several different methods for securing the edges of the synthetic turf material have been suggested in the past. Such methods include providing wooden turf attachments such that the synthetic turf material can be tacked or glued to the wooden turf attachments. Additionally, elaborate concrete curbs/borders have been similarly utilized. Clip or clamp assemblies that seek to engage the edges of the synthetic turf material to hold them in place around the peripheral edge of the installation have also been utilized. All of these prior art methods for securing the edges of synthetic turf materials have suffered from various deficiencies. For example, such prior methods leave a wooden or concrete surface exposed that can lead to injuries.

Accordingly, a need exists for a safe border for a synthetic turf field that provides an aesthetically pleasing appearance.

SUMMARY OF THE INVENTION

In accordance with an example of the invention, provided is a border member for establishing a border around a synthetic turf field. The border member comprises: an elongated body molded from a flexible material; at least one notch formed in an upper surface of the elongated body and extending along a length of the elongated body; and a rigid spine embedded within the elongated body and extending along the length of the elongated body. The border member is positioned adjacent to the synthetic turf field such that a portion of synthetic turf of the synthetic turf field rests on the notch.

The flexible material may be granulated rubber mixed with a urethane binder. The rigid spine may be manufactured from steel, fiberglass, or metal tubing/pipe. The rigid spine may have a substantially L-shaped cross-sectional shape, a substantially rectangular-shaped cross-sectional shape, or a substantially round cross-sectional shape.

The upper surface of the elongated body may be visible when the border member is positioned adjacent to the synthetic turf field and may be provided with a coating to provide the upper surface with a different color and texture than other portions of the elongated body. In one example, a first end of the body may have a first connection member and a second end of the body may have a second connection member that is complimentary with the first connection member such that a plurality of border members can be connected end-to-end. In another example, two notches may be formed in the upper surface of the elongated body.

In accordance with one example of the invention, a synthetic turf border system comprises a plurality of border members. Each border member comprises: an elongated body molded from a flexible material; at least one notch formed in an upper surface of the elongated body and extending along a length of the elongated body; and a rigid spine embedded within the elongated body and extending along the length of the elongated body. Each of the plurality of border members are positioned adjacent to a synthetic turf field such that a portion of synthetic turf of the synthetic turf field rests on the notches of the plurality of border members.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limit of the invention.

BRIEF DESCRIPTION OF THE DRAWINGS

FIG. 8 is a chart illustrating GMax test results for the border member of the present disclosure.

DESCRIPTION OF THE INVENTION

Figures 1A, 2A, 3A:
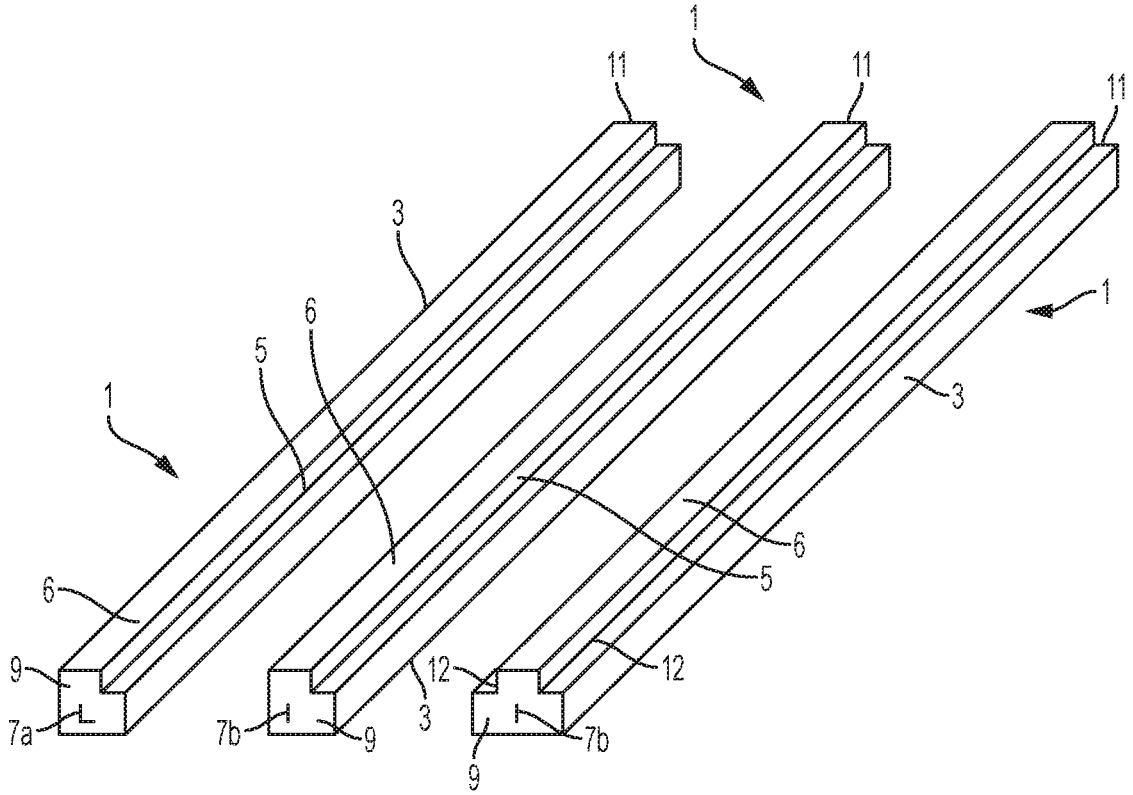
FIGS. 1A and 1B are perspective and front views, respectively, of a border member for use with a synthetic turf border system in accordance with the invention.
FIGS. 2A and 2B are perspective and front views, respectively, of an alternative border member for use with a synthetic turf border system in accordance with the invention.
FIGS. 3A and 3B are perspective and front views, respectively, of another alternative border member for use with a synthetic turf border system in accordance with the invention.

As used herein, the singular form of "a", "an", and "the" include plural referents unless the context clearly dictates otherwise. As used herein, the terms "right", "left", "top", and derivatives thereof shall relate to the invention as it is oriented in the drawing figures. However, it is to be understood that the invention can assume various alternative orientations and, accordingly, such terms are not to be considered as limiting. Also, it is to be understood that the invention can assume various alternative variations and stage sequences, except where expressly specified to the contrary. It is also to be understood that the specific devices and processes illustrated in the attached drawings, and described in the following specification, are examples. Hence, specific dimensions and other physical characteristics related to the embodiments disclosed herein are not to be considered as limiting.

Unless indicated to the contrary, the numerical parameters set forth in the following specification and attached claims are approximations that can vary depending upon the desired properties sought to be obtained by the present disclosure.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include any and all sub-ranges between and including the recited minimum value of 1 and the recited maximum value of 10, that is, all subranges beginning with a minimum value equal to or greater than 1 and ending with a maximum value equal to or less than 10, and all subranges in between, e.g., 1 to 6.3, or 5.5 to 10, or 2.7 to 6.1. In addition, while the border member described hereinafter is described as being used with a synthetic turf field, this is not to be construed as limiting the disclosure as the border member may be utilized as a border with natural grass turf fields and in play areas such as playgrounds.

With reference to FIGS. 1A, 1B, 2A, and 2B, a border member 1 for establishing a border around a synthetic turf field comprises an elongated body 3 molded from a flexible material. The flexible material may be granulated rubber mixed with a urethane binder. The use of such material ensures softness for safety and all weather porosity. Once the granulated rubber is mixed with the urethane binder it is positioned within a mold and allowed to set. Once it has set, the elongated body 3 is removed from the mold and has a length of about 8 to 10 feet. However, the elongated body 3 may be manufactured in other lengths to accommodate customer requirements.

While the flexible material is described hereinabove as being granulated rubber mixed with a urethane binder, this is not to be construed as limiting the invention as any suitable flexible material that can be molded may be utilized. For instance, SBR rubber, EPDM Rubber, TPE, and other plastics and resins may be molded to form the elongated body 3 of the border member 1.

During the molding process, a notch 5 is formed in an upper surface 6 of the elongated body 3 and extends along a length of the elongated body 3. The notch 5 is provided to allow an edge of the synthetic turf field to rest thereon as will be described in greater detail hereinafter. The elongated body 3 is typically about 4 inches wide and about 4 inches tall with the notch 5 being about 1.5 inches wide and about 1.5 inches tall. However, these dimensions are not to be construed as limiting the invention as any suitable size and shape for the elongated body 3 and the notch 5 may be utilized. For instance, the notch 5 may range in size from about 1.5 inches to 2 inches wide and about 0.5 inches to 1.5 inches tall.

Figures 1B, 2B, 3B:
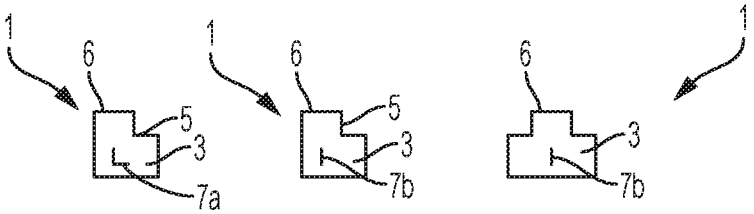

In addition, a rigid spine 7*a*, 7*b* may be embedded within the elongated body 3 during the molding process. The rigid spine 7*a*, 7*b* extends along the length of the elongated body 3 and may be manufactured from steel, fiberglass, metal tubing/pipe, or any other suitable rigid material. In one example, as shown in FIGS. 1A and 1B, the rigid spine 7*a* has a substantially L-shaped cross-sectional shape. This rigid spine 7*a* makes the border member 3 rigid both vertically and horizontally. A border member 1 having such a rigid spine 7*a* is desirably used to border straightaway portions of a synthetic turf field. In another example, as shown in FIGS. 2A and 2B, the rigid spine 7*b* has a substantially rectangular-shaped cross-sectional shape. This rigid spine 7*b* makes the border member 1 rigid horizontally. A border member 1 having such a rigid spine 7*b* is desirably used to border curved portions of a synthetic turf field.

In one example, a first end 9 of the elongated body 3 may have a first connection member (not shown) and a second end 11 of the elongated body 3 may have a second connection member (not shown) that is complimentary with the first connection member such that a plurality of border members 1 can be connected end-to-end.

Alternatively, a rigid tube or other mechanical connection (not shown) may be embedded or molded within the elongated body 3. The rigid tube provides both structural rigidity to the border member 1 and may also extend from one end of the elongated body 3 and mate with a complimentary feature provided on the opposite end of another border member 1 to securely couple a pair of border members 1 together. In addition, the rigid tube may be utilized to run wiring or other utilities therethrough as desired. The rigid tube may be manufactured from galvanized steel or another suitable material.

The upper surface 6 of the elongated body 3 is configured to be visible when the border member 1 is positioned adjacent to a synthetic turf field. Accordingly, the upper surface 6 may be provided with coating to provide a color, design, or finished appearance to the upper surface 6, thereby providing the border member 1 with an aesthetically appealing appearance.

With reference to FIGS. 3A and 3B, another example of a border member 1 is identical to the border member of FIGS. 2A and 2B, except that it includes a slightly larger width of about 5.50 inches and includes a pair of notches 12 formed in the upper surface 6 thereof. The border member 1 of FIG. 3A is configured to be utilized as a border between two synthetic turf fields whereas the border members 1 of FIGS. 1A and 2A are configured to be utilized with a synthetic turf field having a track formed around it as will be discussed in greater detail hereinafter.

Figure 4:
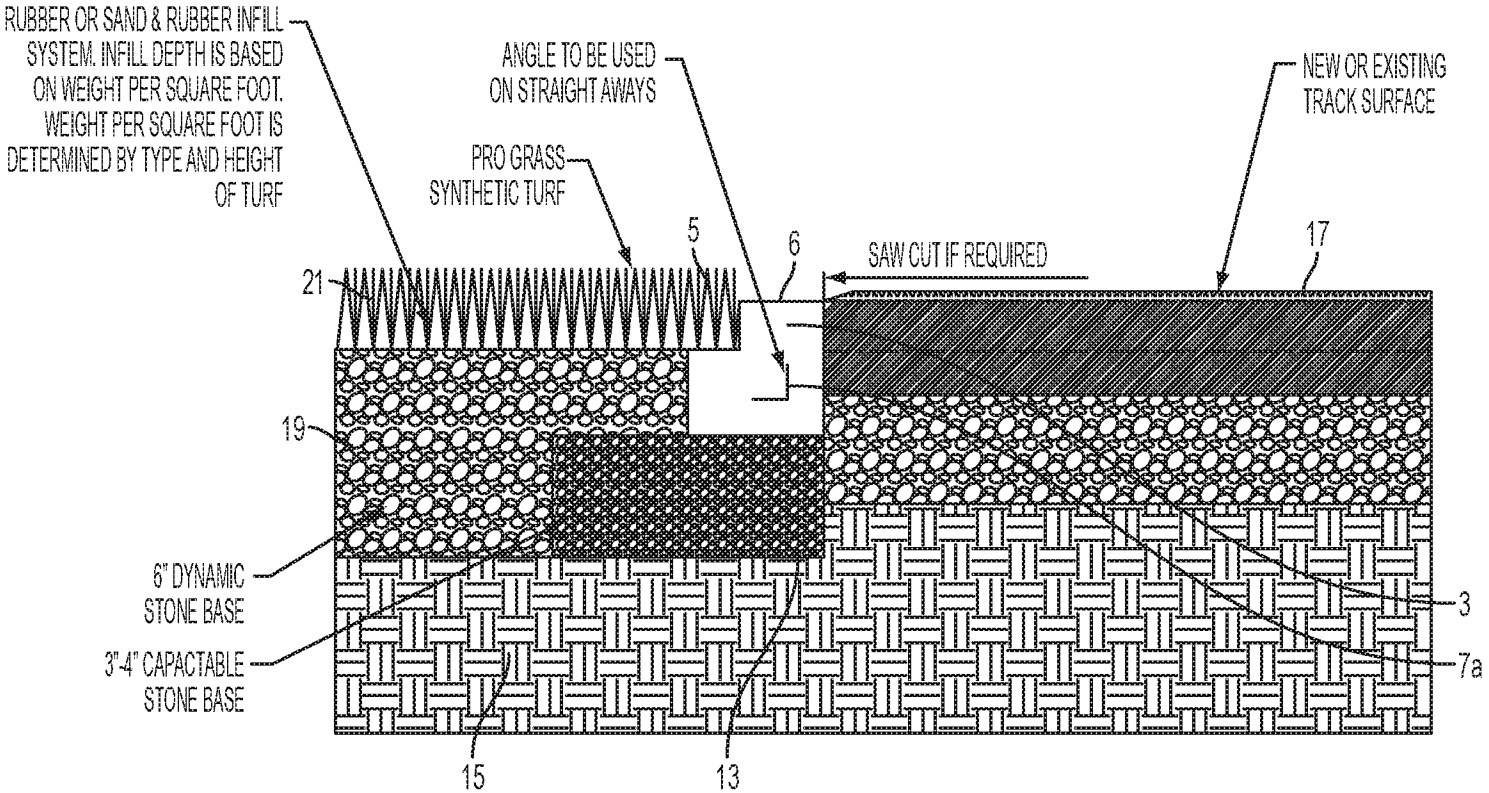
FIG. 4 is a cross-sectional view of the border member of FIGS. 1A and 1B installed in a field.
Figure 5:
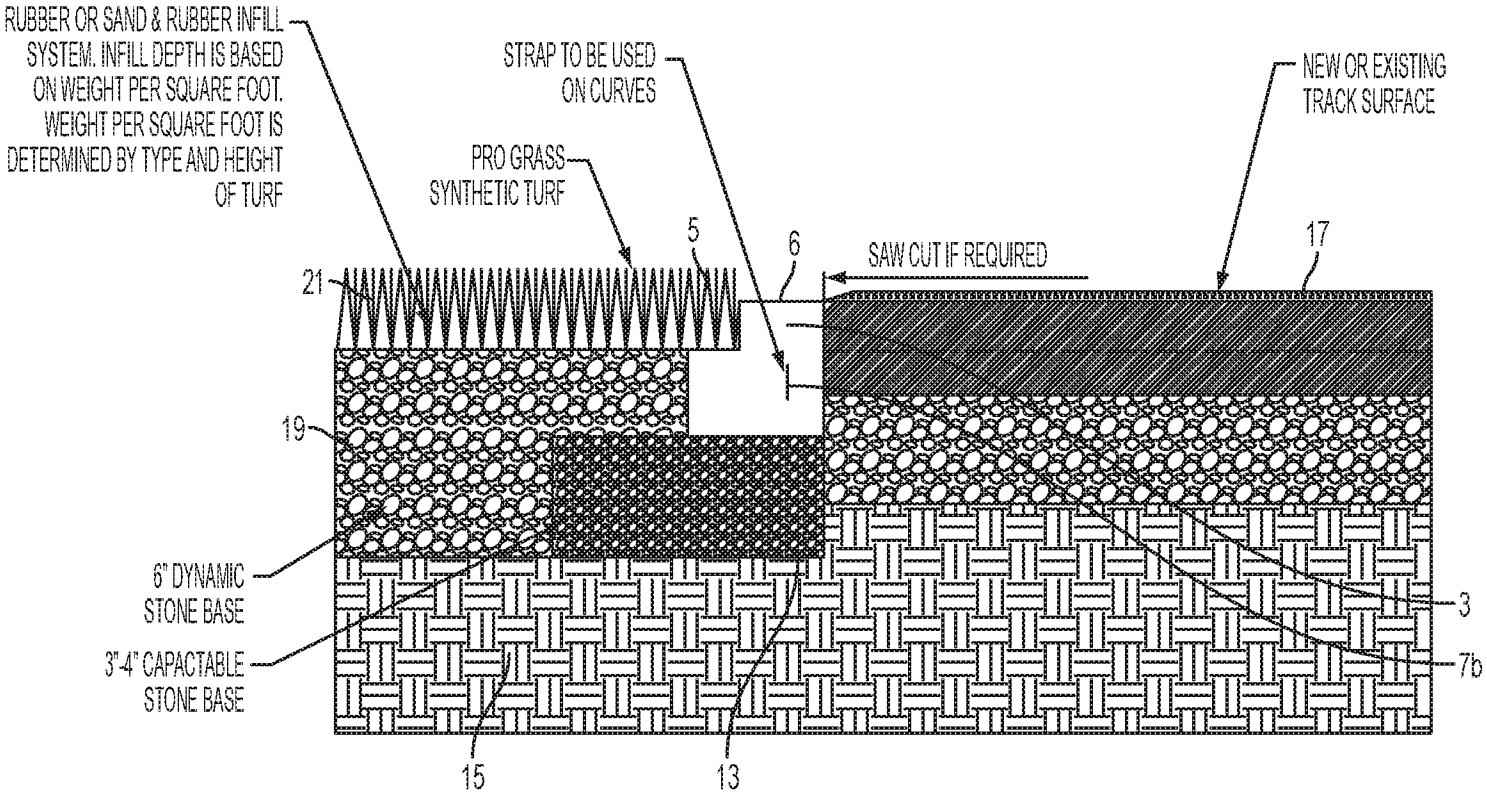
FIG. 5 is a cross-sectional view of the border member of FIGS. 2A and 2B installed in a field.

With reference to FIGS. 4 and 5 and with continued reference to FIGS. 1A, 1B, 2A, and 2B, the border members described hereinabove may be installed as follows. An about 3-4 inch stone base 13 is positioned on a ground surface 15 around the perimeter of the surface upon which the synthetic field is placed and adjacent to a new or existing running track surface 17. Thereafter, the border members 1 are positioned around the area where the synthetic turf field will be placed on the stone base 13 and adjacent to the track surface 17 in an end-to-end manner using the first and second connection members to connect adjacent border members 1. Once the border members 1 are properly positioned, an about 6 inch dynamic stone base 19 is provided on the ground surface 15 beneath where the synthetic turf field will be placed such that the dynamic stone base 19 rises to the level of the notch 5 of the border member 1. Then, synthetic turf 21 is positioned on the dynamic stone base 19 such that a portion of the synthetic turf 21 rests on the notch 5 and the upper surface 6 of the border member 1 is visible.

Figure 6:
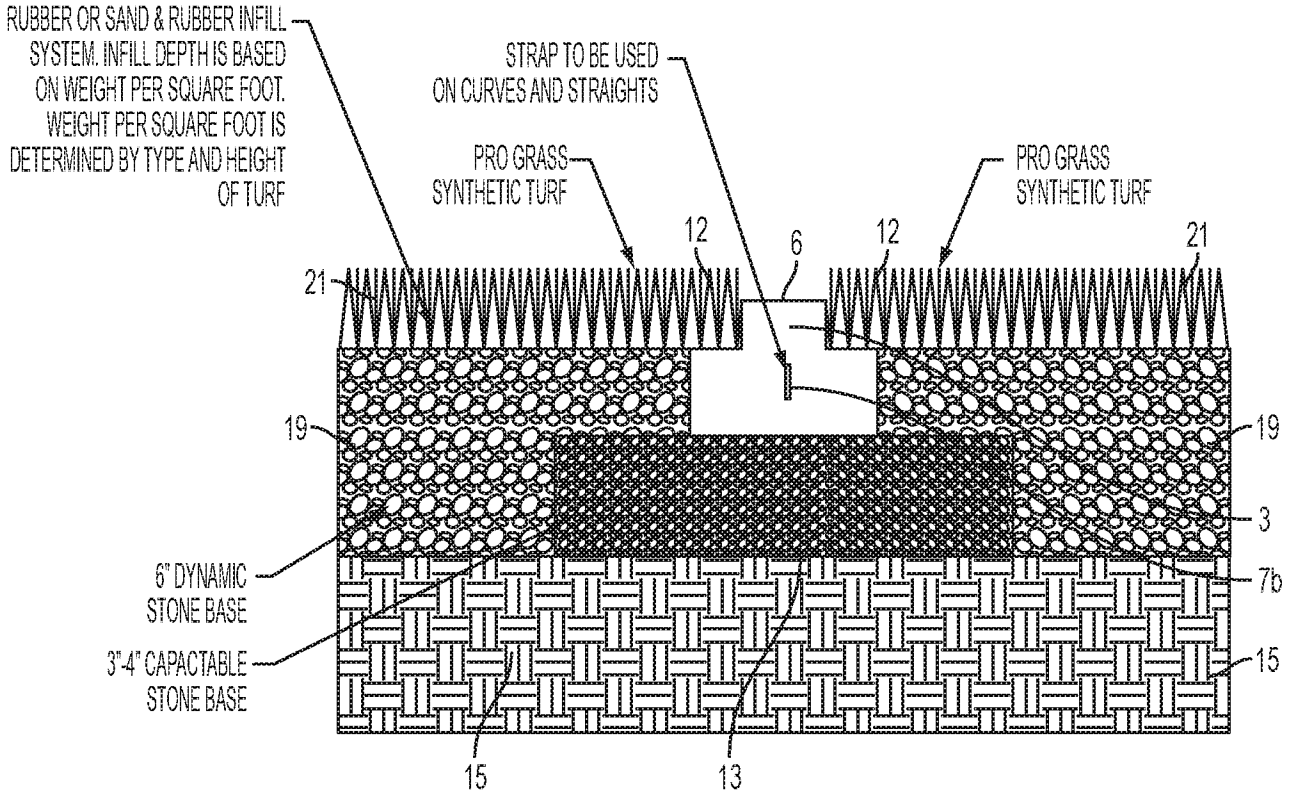
FIG. 6 is a cross-sectional view of the border member of FIGS. 3A and 3B installed in a field.

With reference to FIG. 6 and with continued reference to FIG. 3A, the border member 1 of FIG. 3A is installed in the same manner as the border members 1 of FIGS. 1A and 2A, except that instead of being positioned adjacent to a running track, it is positioned between two synthetic turf fields and a portion of synthetic turf 21 of each of the synthetic turf fields rests on the notches 12 and the upper surface 6 of the border member 1 is visible as shown in FIG. 6.

Figure 7A:
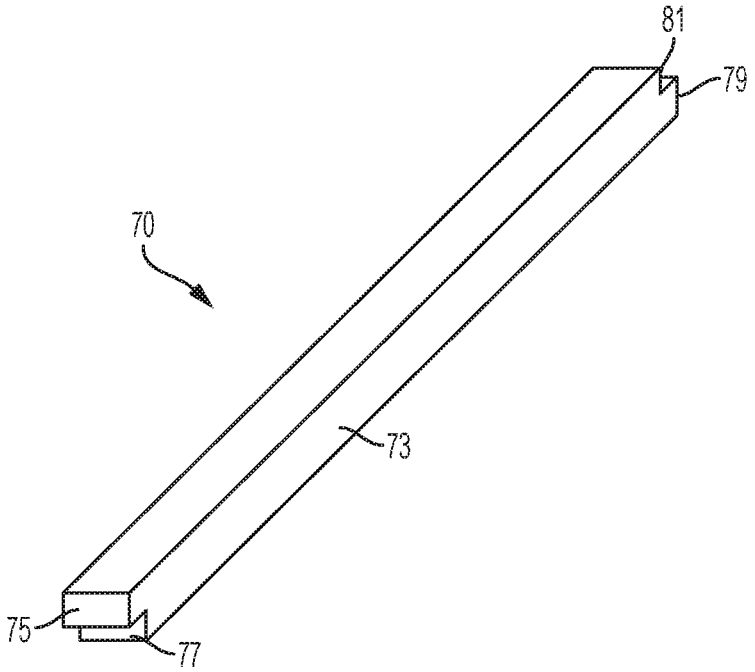
FIGS. 7A and 7B are perspective and front views, respectively, of a border member for use with a playground.
Figure 7B:
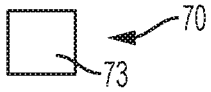

With reference to FIGS. 7A and 7B, another example of a border member 70 is illustrated and is configured for use as a playground border. Border member 70 includes an elongated body 73 that is molded in the same manner and from the same materials as border members 1 discussed hereinabove. The border member 70, however, does not include a rigid spine, thereby making it flexible in all directions. In addition, the border member 70 can be manufactured in varying lengths to accommodate customer requirements. The body 73 further comprises a first end 75 having a first connection member 77 and a second end 79 having a second connection member 81 that is complimentary with the first connection member 77 such that a plurality of border members 70 can be connected end-to-end.

Testing

The border members of the present disclosure were GMax tested to measure the shock-absorbing properties thereof. The higher the GMax value, the harder the surface. GMax measurements are a fundamental tool of athletic field safety testing and are useful in assessing the "playability" of a field. The GMax Testing standard used to test the border members 1 utilizes the American Society for Testing and Materials (ASTM) specifications F355 and F1936. In addition, for comparison, various other materials that are used for border materials, such as wood and concrete, were also GMax tested.

With reference to FIG. 8, the results of the GMax test indicated that the border members 1 of the present disclosure achieved GMax scores between an average of 76.8 and 99.1. On the other hand materials such as concrete (GMax score of 651) and plywood (GMax score of 243.7) had significantly higher GMax scores. Accordingly, the border members 1 provide a much safer synthetic playing field border than currently offered solutions.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment may be combined with one or more features of any other embodiment.

The invention claimed is:

1. A synthetic turf border system comprising:

a plurality of border members each comprising:

an elongated body molded from a flexible material;

at least one flat notch formed in an upper surface of the elongated body and extending along a length of the elongated body; and a rigid spine embedded within the elongated body and extending along the length of the elongated body, wherein the rigid spine has a substantially L-shaped cross-sectional shape for providing horizontal and vertical rigidity to each border member for bordering straightaway portions of a synthetic turf field or a substantially rectangular-shaped cross-sectional shape for providing horizontal rigidity to each border member for bordering curved portions of the synthetic turf field, wherein each of the plurality of border members are configured to be positioned adjacent to a synthetic turf field such that a portion of synthetic turf of the synthetic turf field rests on the flat notches of the plurality of border members, wherein each of the plurality of border members further comprises a first end of the elongated body having a first connection member and a second end of the elongated body having a second connection member that is complimentary with the first connection member, and wherein the plurality of border members are connected end-to-end for surrounding the synthetic turf field such that each of the plurality of border members including the rigid spine having the substantially L-shaped cross-sectional shape are configured to be positioned adjacent to the straightaway portions of the synthetic turf field and each of the plurality of border members including the rigid spine having the substantially rectangular-shaped cross-sectional shape are configured to be positioned adjacent to the curved portions of the synthetic turf field.

2. The system of claim 1, wherein the flexible material is granulated rubber mixed with a urethane binder.

3. The system of claim 1, wherein the rigid spine is manufactured from at least one of steel and iron.

4. The system of claim 1, wherein the upper surface of each of the elongated bodies of each of the plurality of border members is visible when the border member is positioned adjacent to the synthetic turf field.

5. The system of claim 4, wherein the upper surface is provided with a coating to provide the upper surface with a different color than other portions of the elongated body.

6. The system of claim 1, wherein the portion of synthetic turf of the synthetic turf field rests directly on the flat notches of the plurality of border members.

7. A synthetic turf border system, comprising:

a plurality of border members, each including:

an elongated body molded from a flexible material, at least one flat notch formed in an upper surface of the elongated body and extending along a length of the elongated body, and a rigid spine embedded within the elongated body and extending along the length of the elongated body; and a synthetic turf field having straightaway portions and curved portions, wherein the rigid spine has a substantially L-shaped cross-sectional shape for providing horizontal and vertical rigidity to each border member for bordering the straightaway portions of the synthetic turf field or a substantially rectangular-shaped cross-sectional shape for providing horizontal rigidity to each border member for bordering the curved portions of the synthetic turf field, wherein the plurality of border members are connected end-to-end for surrounding the synthetic turf field such that each border member including the rigid spine having the substantially L-shaped cross-sectional shape is positioned adjacent to the straightaway portions of the synthetic turf field and each border member including the rigid spine having the substantially rectangular-shaped cross-sectional shape is positioned adjacent to the curved portions of the synthetic turf field, and wherein each border member is positioned adjacent to the synthetic turf field such that a portion of synthetic turf of the synthetic turf field rests on the at least one flat notch.

* * * * *